US007201093B2

(12) United States Patent
Lee

(10) Patent No.: US 7,201,093 B2
(45) Date of Patent: Apr. 10, 2007

(54) HAIR HOLDING CAP FOR A HAIR BRAIDER

(76) Inventor: Myun Woo Lee, 103-20, Sungsan-dong, Mapo-gu, Seoul (KR) 121-250

( * ) Notice: Subject to any disclaimer, the term of this patent is extended or adjusted under 35 U.S.C. 154(b) by 144 days.

(21) Appl. No.: 10/398,866

(22) PCT Filed: Dec. 21, 2000

(86) PCT No.: PCT/KR00/01505

§ 371 (c)(1),
(2), (4) Date: Apr. 10, 2003

(87) PCT Pub. No.: WO02/30235

PCT Pub. Date: Apr. 18, 2002

(65) Prior Publication Data

US 2004/0011374 A1 Jan. 22, 2004

(30) Foreign Application Priority Data

Oct. 12, 2000 (KR) ..... 2000/60124

(51) Int. Cl.
*D04C 7/00* (2006.01)

(52) U.S. Cl. ..... 87/61

(58) Field of Classification Search ..... 87/61; 132/212

See application file for complete search history.

(56) References Cited

U.S. PATENT DOCUMENTS

| | | | | |
|---|---|---|---|---|
| 1,683,898 | A * | 9/1928 | Johnson | 87/61 |
| 2,121,739 | A * | 6/1938 | Janssen | 87/61 |
| 4,369,690 | A * | 1/1983 | Sapkus | 87/33 |

FOREIGN PATENT DOCUMENTS

| | | | |
|---|---|---|---|
| JP | 60-47404 | U | 4/1985 |
| JP | 60-77501 | U | 5/1985 |
| JP | 62-18122 | U | 3/1987 |
| JP | 63-117122 | U | 7/1988 |
| JP | 4-73301 | U | 6/1992 |
| JP | 4-93002 | U | 8/1992 |

* cited by examiner

*Primary Examiner*—Shaun R Hurley
(74) *Attorney, Agent, or Firm*—Rothwell, Figg, Ernst & Manbeck, P.C.

(57) ABSTRACT

The present invention relates to a hair gripping device to be mounted on a hair accommodating tube to grip a bundle of hair in a proper friction force during hair braiding by a hair braiding machine. The present hair gripping device comprises a tapered head portion having a nozzle for the bundle of hair to pass through; and a body portion, extended from the head portion in one piece, having a plurality of inner partition walls to give the bundle of hair a zigzag, spiral, or helical bends, thereby tensioning the bundle of hair properly during a braiding and/or releasing it smoothly at the end of braiding. Accordingly, a uniform and tidy, style of braided hair is obtained.

21 Claims, 7 Drawing Sheets

HAIR HOLDING CAP FOR A HAIR BRAIDER

1. TECHNICAL FIELD

The present invention relates to a hair gripping device, mounted on a hair accommodating tube detachably combined with a hair braiding machine, to grip strands of hair in a proper friction force during hair braiding with a hair braiding machine.

2. BACKGROUND ART

Usually, hair is manually braided by a person other than the one who is obtaining a desired hair style. This braiding work requires considerable time and cost. Also, as the quality of such a manually braided hair style totally depends on the worker's skill, it may not be uniform.

Therefore, a hair braiding machine braiding a plurality of strands of hair into one braid mechanically was developed and filed in KIPO (Korea Industrial Property Office) on the Jan. 18, 2000 with Application No. 2000-4184.

As shown in FIGS. 1A and 1B, the hair braider generally; comprises a driving unit 200 and three hair accommodating members 100 mounted on the driving unit 200 and driven in a figure eight '8' configuration by the driving unit 200. Each of the hair accommodating members accommodates each strands of hair to separate them from the other strands for the purpose of preventing hair strands from being tangled when a plurality of hair strands are braided each other.

On the top of each hair accommodating member 100 is installed a cap 106 shown in FIG. 2, which frictionally grips a bundle of hair with an elastic nozzle 106*a* thereof to tension it while hair is braided through '8'-shaped movement of each hair accommodating member 100, whereby uniformly-braided hair is obtained.

As mentioned above, it is required to maintain a proper tension on the strands of hair in a braiding process to get; uniformly-braided hair. While hair is braided by a figure eight movement of each hair accommodating member 100, the overall length of the hair strands accommodated in a hair accommodating member 100 is gradually shorter. Namely, the hair strands are drawn out through the nozzle 106*a*. However, if the friction between the nozzle 106*a* and the hair strands is excessive because of a smaller inner diameter of the nozzle 106*a*, it hinders the hair strands from being drawn out of the nozzle 106*a* smoothly, thereby tensioning the hair strands more excessively. This excessive tension on the hair strands gives pains to the person and might stop a motor of the driving unit 200 as well.

In addition, all of hair strings are not same in length, thus, short hair strings are abruptly released from the nozzle 106*a* if the tension on the hair strands is too excessive as explained above. Then, the released short hair strings are not woven with still united long hair, namely, they are rotated freely without being braided. These loosened hair strings give untidiness to the finished hair style.

Conversely, if the friction force is not sufficient, the hair strands cannot be held in a constant tension so that some hair strings are drawn out, through the nozzle 106*a*, more than the shortened length by braiding, which leads to bumpy braided hair. This also looks untidy.

Accordingly, it is required in braiding hair with a hair braiding machine that a cap mounted on the hair accommodating member should give a substantially constant and proper tension to accommodated hair until the end of hair is completely released through the cap from the hair accommodating member. A development of such a cap is very important subject for a hair braiding machine ensuring good performance and good quality of braided hair.

3. DISCLOSURE OF INVENTION

It is an object of the present invention is to provide a hair gripping cap whose structure gives a constant and proper tension to hair strands braided mechanically until the hair strands are completely released therefrom.

A hair gripping cap in accordance with the present invention comprises a tapered head portion having a nozzle for a bundle of hair to pass through; and a cylindrical body portion, coaxially extended from the head portion in one piece, having a plurality of inner partition walls to give a desired tension to hair being braided by passing the bundle of hair zigzag or spirally through spaces formed by the inner partition walls.

The hair gripping cap in accordance with the present invention applies a constant and proper tension on hair being mechanically braided until the hair is completely braided and released from a hair braiding machine, thereby ensuring a uniformity and tidiness of braided hair.

4. BRIEF DESCRIPTION OF DRAWINGS

The accompanying drawings, which are included to provide a further understanding of the present invention, illustrate the preferred embodiments of the invention, and together with the description, serve to explain the principles of the present invention, and wherein.

Figure 1A:
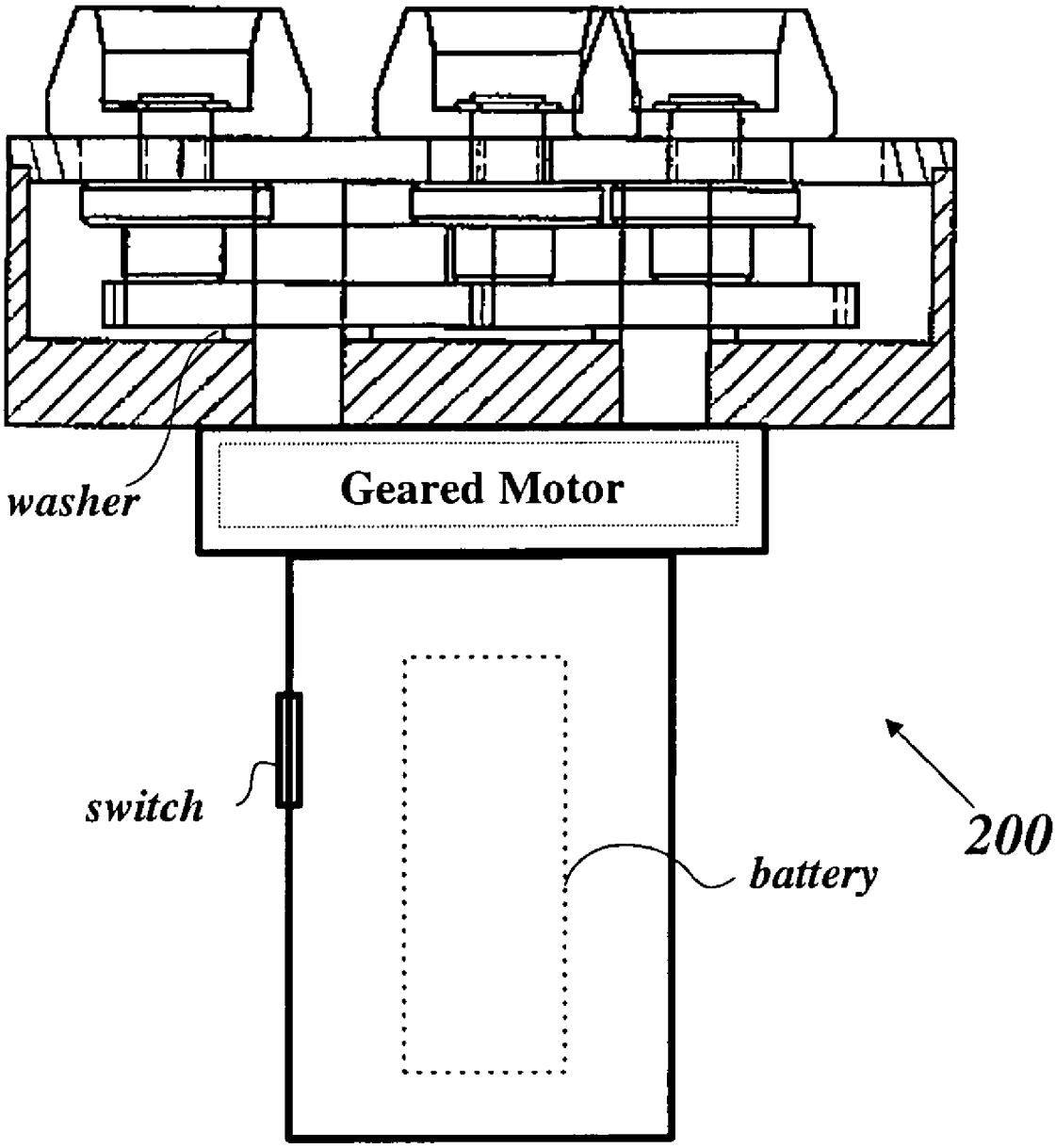
FIG. 1A (Prior Art)
FIG. 1A is a longitudinal partially sectional view of a mechanical hair braider.
Figure 1B:
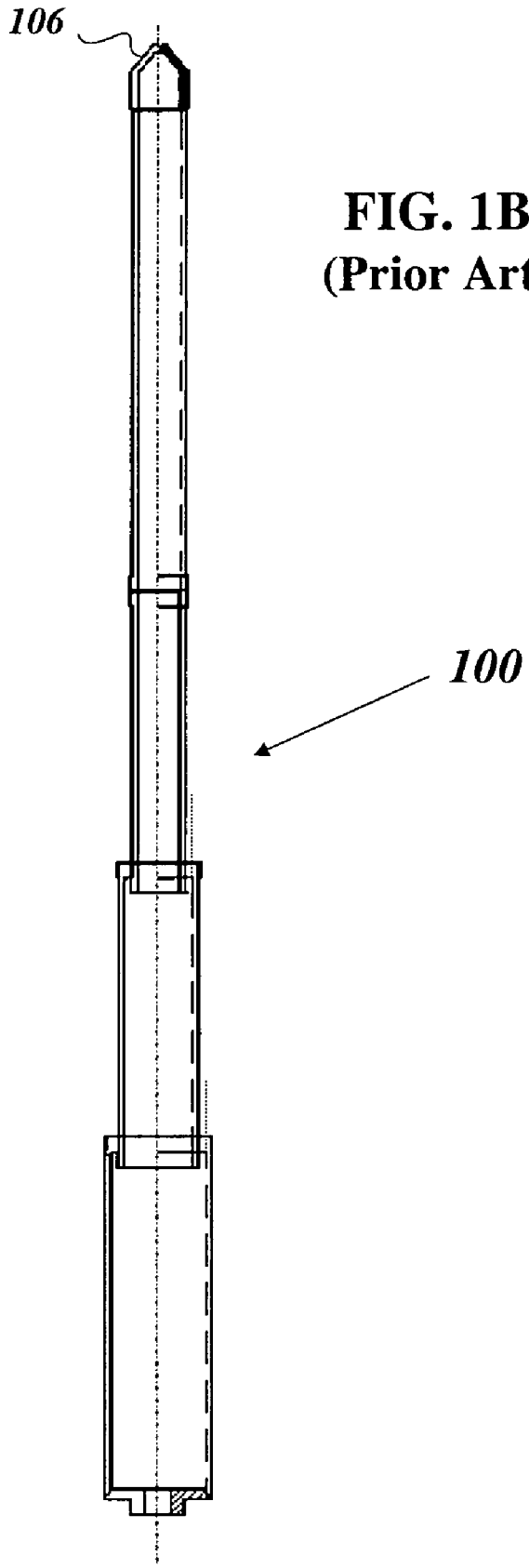
FIG. 1B (Prior Art)
FIG. 1B is a sectional view of a hair accommodating member, an auxiliary member of a hair braider, each tube of which is extended.
Figure 2:
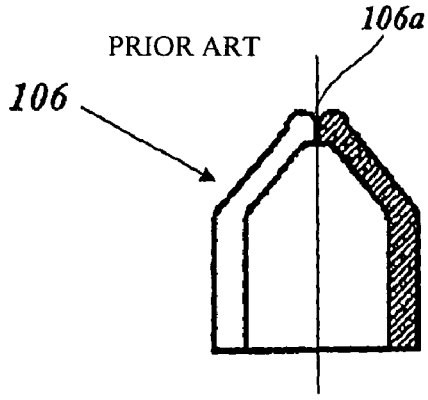
FIG. 2 PRIOR ART
Figure 3A:
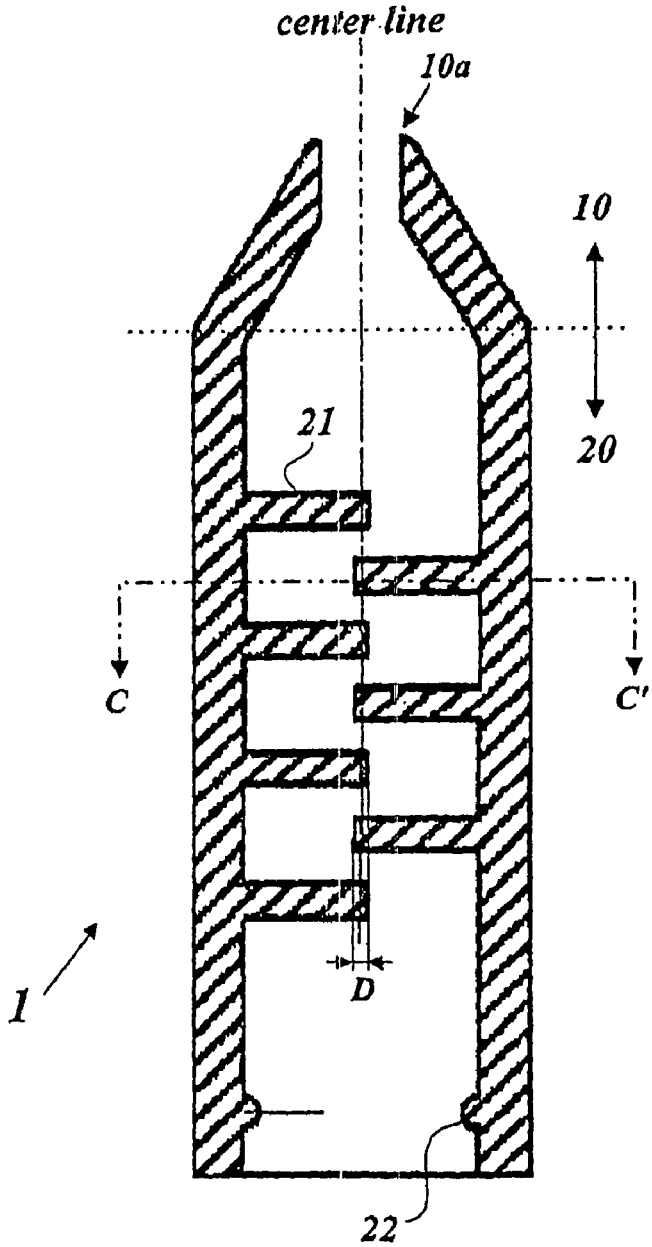
Figure 3B:
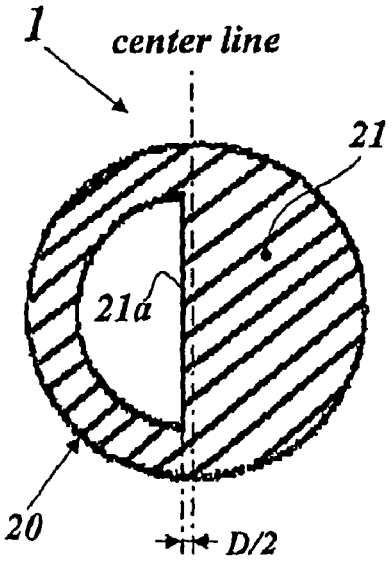
Figure 4:
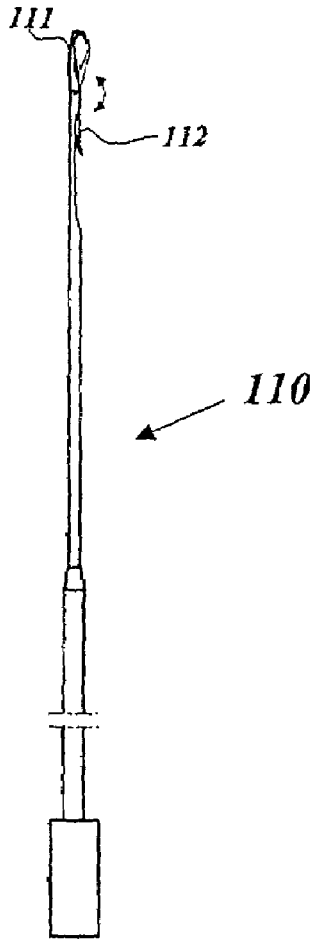
Figure 5:
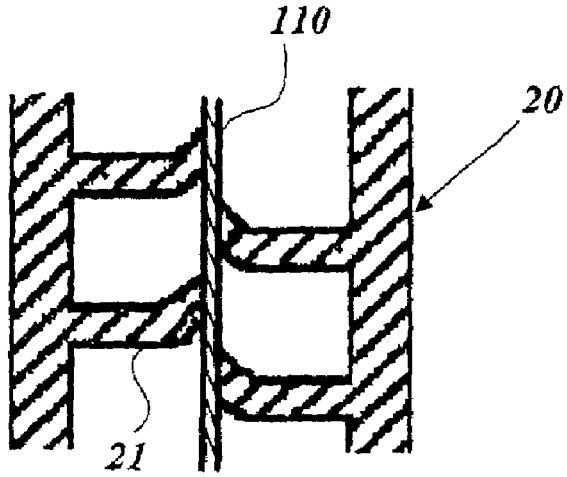
Figure 6:
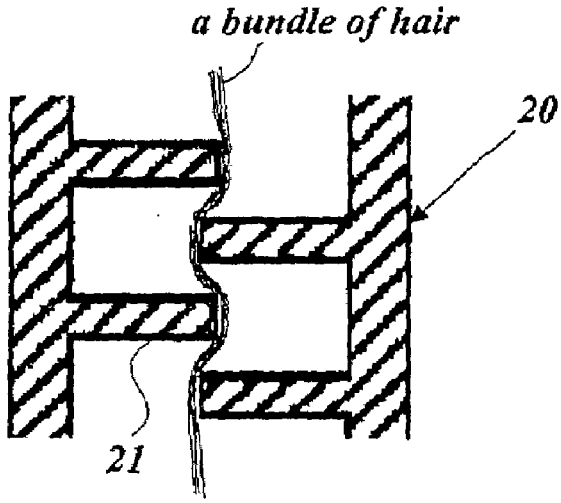
Figure 8:
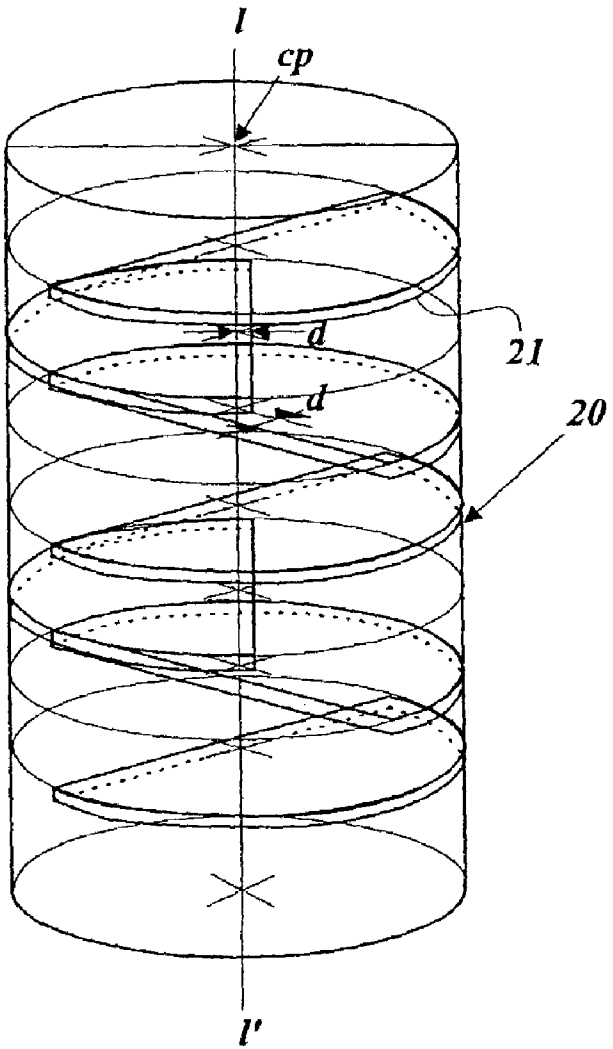
Figure 7:
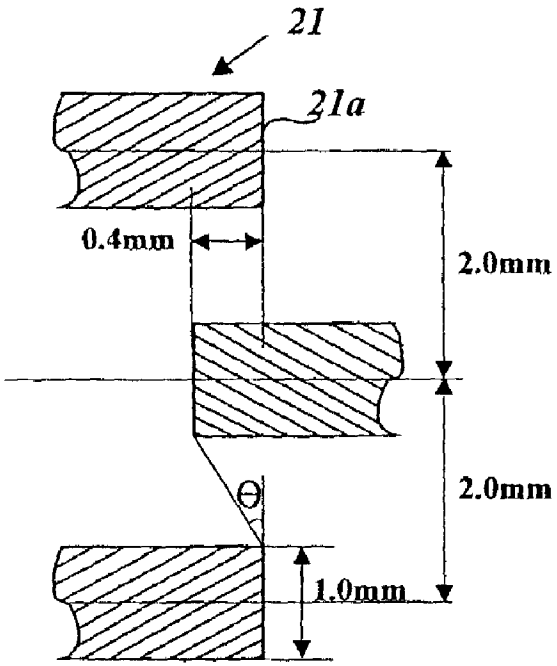
Figure 9:
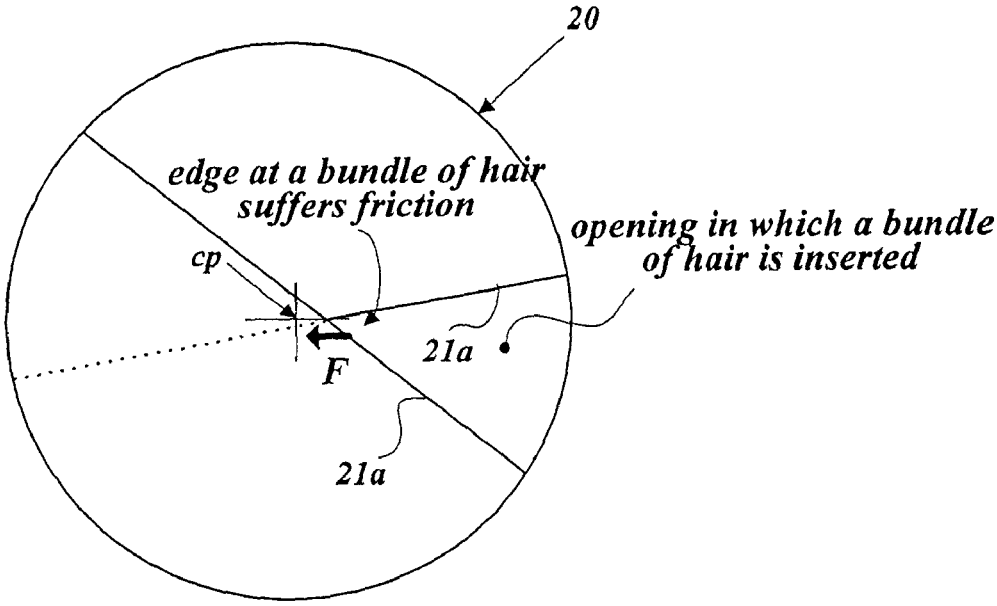
Figure 10:
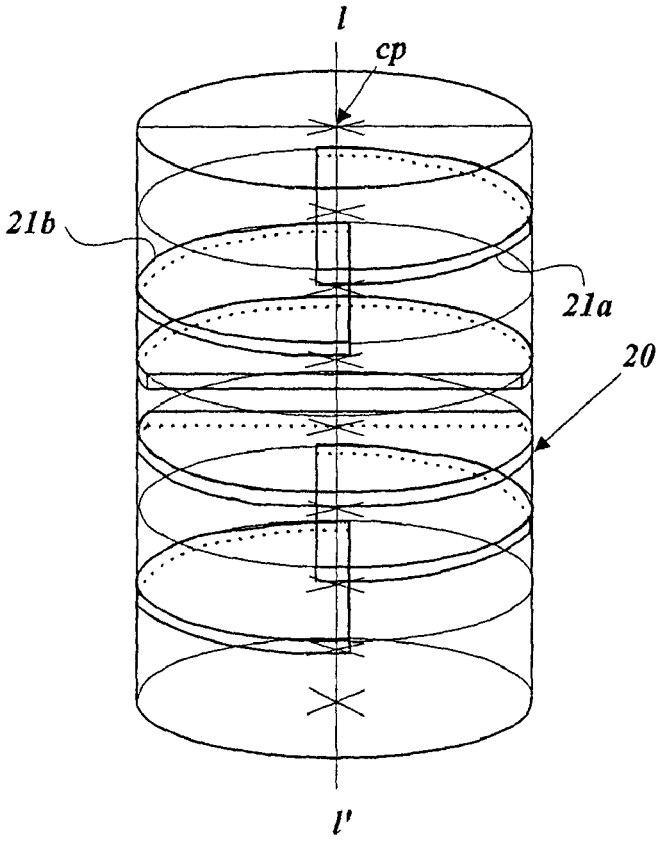
Figure 11:
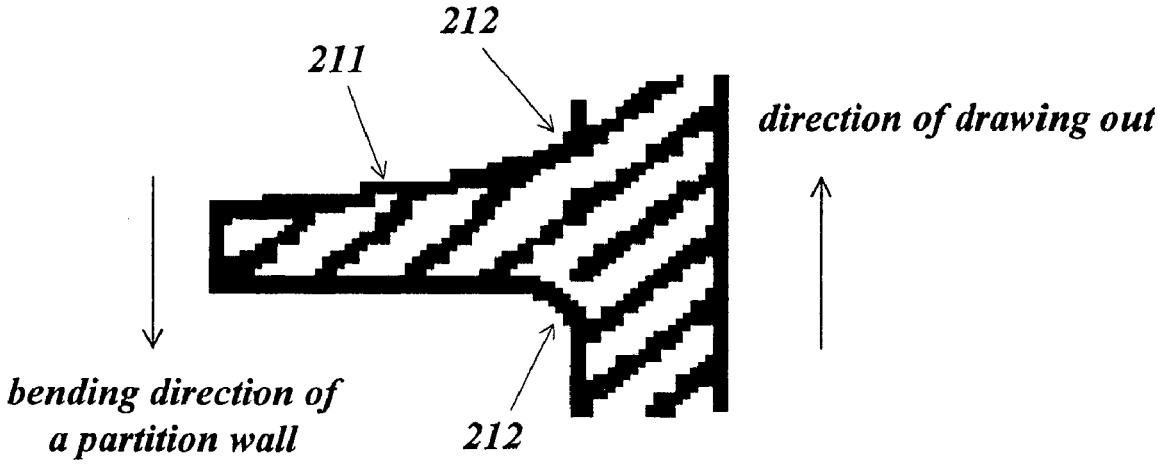
Figure 12:
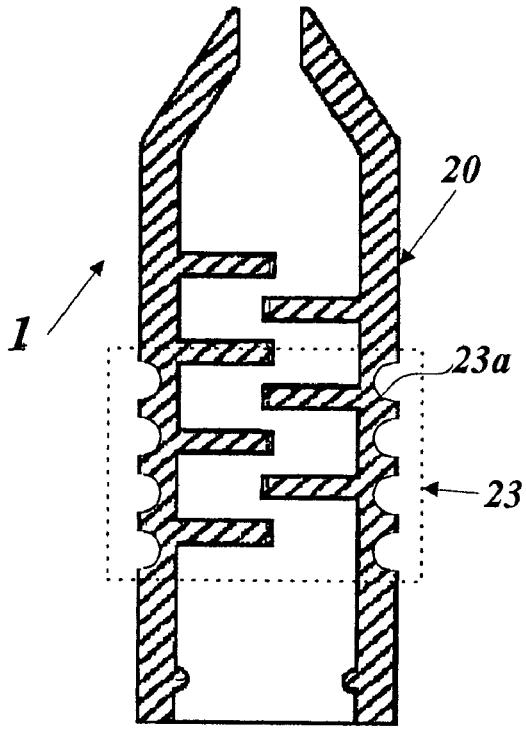

FIG. 2. is a side sectional view of a cap to be mounted on the top of the hair accommodating member;

FIG. 3A is a side sectional view of a cap, an embodiment of the hair gripping member according to the present invention;

FIG. 3B is a cross sectional view of the cap taken along the line C–C' of the FIG. 3A;

FIG. 4 is a side elevational view of a needle member hooking hair to take them into the hair accommodating member of the FIG. 1B;

FIG. 5 is a side sectional view of the cap of the FIG. 3A with the inner partition walls deflected after the needle member of FIG. 4 hooking hair is passed by;

FIG. 6 is a side sectional view of the cap whose inner partition walls pushing hair after the needle member of FIG. 4 hooking the hair is extracted back;

FIG. 7. is a partially enlarged view of the cap of FIG. 3A;

FIG. 8 is a perspective view of a cap, another embodiment of the hair gripping member in accordance with the present invention;

FIG. 9 is a schematic drawing for explaining a principle of generating a proper friction force on the hair in the cap of FIG. 8;

FIG. 10 is a perspective view of a cap, the third embodiment of the hair gripping member in accordance with the present invention;

FIG. 11 is a partially enlarged view of a cap whose inner partition walls are structured for the purpose of well formation of the inner walls in injection molding process; and FIG. 12 is a longitudinally sectional view of a cap, the fourth embodiment of the hair gripping member, which is, liable to be bent.

5. MODES FOR CARRYING OUT THE INVENTION

Referring now to the drawings, a preferred embodiment of the present invention will be described.

As shown in FIGS. 3A and 3B, a cap according to the present invention comprises a tapered head portion 10 having a nozzle 10*a* to pass strands of hair therethrough; and a cylindrical body portion 20, coaxially extended from the head portion 10 in one piece, having a plurality of inner partition walls 21 applying a constant and proper friction to hair strands passing thereby zigzag. An annular rib 22 is radially extended from the inner side wall of the body portion 20 to have the cap 1 fitted on a hair accommodating member 100 of FIG. 1B to a predetermined depth. The head portion 10 and the body portion 20 are made of elastic rubber materials.

Each partition wall 21 is horizontally extended from the inner side wall of the body portion 20 to define an opening for hair to pass through and has an configuration of almost semi-circular plate slightly larger than a half of the full circular plate. In the view of the top, two adjacent partition walls 21 extended from opposite sides are slightly-overlapped (marked 'D' in the FIG. 3A) at respective both ends 21*a*. The partition wall 21 made of elastic materials is liable to be deflected by forces.

The cap, an embodiment according to the present invention, configured as above operates as follows.

The needle member 110 of FIG. 4 for hooking a bunch of hair passes through all tubes of the hair accommodating member 100 and the cap 1 mounted on an upper tube. As shown in FIG. 5, the partition walls 21 formed in the cap 1 are elastically deflected by the needle member 110 made of steel inserted thereinto.

The needle member 110 captures a bunch of hair with a hook. 111 provided on the top thereof. As the needle member 110 is pulled back into the cap 1, a closing pin 112 pivotally swings at the edge of the cap 1 or the end of the most upper wall 21 to enclose the hook 111. While the needle member 110 is downwardly drawn out of all the folded tubes of the hair accommodating member 100, the hook 111 with its opening closed by the pin 112 slides the captured bundle of hair between the partition walls 21 and then into all the tubes.

After the needle member 110 comes out of the tubes of the hair accommodating member 100, the partition walls 21 are elastically restored to their planar shapes and make the hair strands be bent in zigzag therebetween, as shown in FIG. 6.

Several, for example, three hair accommodating members 100 are detachable combined with a driving unit 200 of the hair braider and move along a figure eight by the driving unit 200. Then, the three bundles of hair accommodated in the hair accommodating members 100 start to be braided from the head side. As each bundle of hair is progressively braided, it gets gradually shorter. Accordingly, the bundle of hair in the hair accommodating member 100 is outwardly drawn through the cap 1 as much as the hair get shorter.

The bundle of hair is drawn out overcoming the friction force caused from the viscosity of hair and each elastic partition wall 21. The drawing gives a tension to the bundle of hair. The tension applied on the hair being drawn presses the bundle of hair against the end 21*a* of each partition wall 21, which produces proper friction force resisting against the drawing force. Therefore, each bundle of hair is continuously tensioned until it is completely braided with other bunches of hair.

Because the ends of some hair strings shorter than the end of the bundle of hair pass away from the partition walls 21 one by one, the friction force on the shorter some hair strings is gradually decreased. Therefore, the ends of the hair strings is not abruptly released so that the smoothly released short hair strings are still stuck on the bundle of hair gripped by the cap 1 because of viscosity of hair. As a result, the bundle of hair can be tidily braided to the end of a braiding work.

FIG. 3A is a preferred structure embodying the present invention, which can produce a proper friction force to be required for the tidy braiding formation without any pains to a person. FIG. 7 is a partially enlarged view of the preferred structure of the FIG. 3A.

As shown in FIG. 7, the thickness of each partition wall 21 is about 1 mm and the deflection angle θ between an imaginary perpendicular line and two joining line between two ends 21*a* of two adjacent partition walls 21 is 20 to 25 degrees, preferably 22 degrees. In the embodiment of FIG. 3A, the seven partition walls 21 are formed on the inner space of the cap 1 in such a manner that two laterally opposed and longitudinally adjacent partition walls 21 are overlapped by 0.4 mm and the distance between them is 2 mm.

In the above embodiment, the same friction force can be obtained by reducing the number of the partition walls as increasing the deflection angle θ or by increasing the number of the partition walls as decreasing the deflection angle θ. To increase the deflection angle θ, the partition walls may be overlapped as much more or the longitudinal gap may be shorter. To decrease the deflection angle, the partition walls are formed in the contrary manner.

Thereby, the cap producing a friction force suitable to the thickness of a bundle of hair may be used; by using a cap of a smaller deflection angle θ to obtain a thicker braided style or by using a cap of a greater deflection angle θ to obtain a thinner braided style. Namely, a desired uniform friction force can be produce on a bundle of hair regardless of its thickness.

Otherwise, by varying the deflection angle θ in every two adjacent partition wall, a cap for generating different friction force from the above embodiment may be manufactured.

For example, it may be rendered that, for a thinner braiding, two most upper partition walls are overlapped by 0.8 mm to get a greater deflection angle and the other lower partition walls are overlapped by 0.4 mm, and that, for a thicker braiding, two most lower partition walls are not overlapped and the other upper partition walls are overlapped by 0.4 mm.

FIG. 8 shows another embodiment of a cap, of which a body portion 20 has the partition walls helically arranged on the inner side wall thereof as a whole.

In the embodiment of FIG. 8, the partition walls 21 are formed in such a manner that each partition wall 21 is arranged at the position shifted clockwise by 120 degrees to the adjacent and each partition wall 21 has a configuration of an almost semi-circular plate, which is slightly greater than a half of a full circle by a predetermined distance (marked 'd' in FIG. 8) from the imaginary center 'CP' of the body portion 20.

Thereby, a bundle of hair is passing through the body portion 20 in such a manner that it is offset from the imaginary axis 1–1' by a distance. 'd' and is turned spirally by 60 degrees at each partition wall 21.

When a bundle of hair in the hair accommodating member 100 passes through the cap 1 of FIG. 8 by braiding, it acts a perpendicular force at each contacting point, where two partition walls intercross, towards the imaginary center CP as schematically depicted in FIG. 9. As the perpendicular force increases the friction force, a required tension may be acted on a bundle of hair.

The embodiment of FIG. 8 may obtain various friction force for various desired tension by varying the number of the partition walls and/or the offset distance 'd' from the imaginary center CP. If such various caps are prepared, the most suitable one producing desired tension is selected among them for thickness of a bundle of hair and/or viscosity of hair of a person.

FIG. 10 shows another embodiment of the body portion 20 of a cap of the present invention combined structures of FIGS. 3A and 8.

The embodiment of the FIG. 10 comprises three couples of partition walls 21*a* and 21*b* longitudinally spaced each other on the inner side wall of the body portion 20. Each couple of partition walls 21*a* and 21*b*, formed at opposite side, is composed of two semi-circular plates which are overlapped by about 0.4 mm. Three couples of partition walls are staggered to each other by 90 degrees.

As a cap is usually manufactured in and drawn out from a mold, each partition wall 21 may be cracked on the neck because of pressure caused during drawing or be torn off partially because of adhesive strength between a partition wall and a mold. In this case, a cracked or torn partition wall 21 can not work properly because it has not enough elastic force to resist against drawing force generated during hair braiding and is deflected very readily towards hair drawing direction.

Accordingly, the neck of the partition wall 21, as shown in FIG. 11, has a tapered side 211 and a round reinforcement 212 to prevent the neck from being cracked or damaged during drawing out from a mold and to be strong enough to endure the bending pressures applied from structure of a mold.

In the embodiment of FIG. 11, The tapered side 211 is preferably formed at a front side with respect to drawing direction in order that a cap, having partition walls might be easily drawn out of a mold by being bent well backward with respect to drawing direction.

As bundles of hair come together at a braiding point, they act lateral forces on the hair accommodating members 100 while being braided, thus, a hair gripping cap is preferably manufactured as shown in FIG. 12. to absorb the lateral forces. If the lateral force is not absorbed, a bundle of hair cannot be smoothly drawn out from the cap because it is bent at great angle at the nozzle 10*a*.

As shown in FIG. 12, the cap 1 has a bending neck 23 including a plurality of radial annular grooves 23*a* on the outer side wall of the body portion 20, which absorbs the lateral forces by being bent inward against the forces. Because the cap 1 is smoothly bent around its bending neck 23 a bundle of hair is drawn out along smooth arc path formed by the cap 1.

The invention claimed is:

1. A hair gripping device to be mounted on a hair accommodating means to grip a bundle of hair in a proper friction force during hair braiding, comprising:

a tapered head portion having a nozzle for the bundle of hair to pass through; and a body portion, extended from the head portion in one piece, having a plurality of inner partition walls to have the bundle of hair bent at least once, wherein the plurality of partition walls are longitudinally apart from each other in a predetermined distance, and at least one partition wall is formed in such a manner that a bottom connected to the body portion is thicker than an end thereof.

2. A hair gripping device according to claim 1, wherein the body portion is in cylindrical shape.

3. A hair gripping device according to claim 1, wherein each of the partition wall is extended from an inner side wall thereof to form an almost semi-circle and is apart longitudinally from neighboring partition walls so that an imaginary line connecting two ends of most adjacent partition walls might be at about 20 to 25 degrees with respect to a perpendicular line.

4. A hair gripping device according to claim 3, wherein each of the partition walls is 1.0 mm in thickness and vertically overlapped by 0.4 mm with a neighboring partition wall.

5. A hair gripping device according to claim 1, wherein the partition walls are formed at alternately opposite sides.

6. A hair gripping device according to claim 1, wherein the body portion has at least one annular groove formed on an outer wall to reduce the thickness thereof.

7. A hair gripping device according to claim 1, wherein the head portion, body portion, and each partition wall are made of elastic rubber in a piece.

8. A hair gripping device according to claim 1 wherein the partition wall has a tapered side.

9. A hair gripping device according to claim 1, wherein each of the partition walls has a neck portion to be connected to the body portion in a predetermined curvature, the neck portion being gradually thicker from the end to the body portion.

10. A hair gripping device according to claim 1, wherein some of the partition walls are different from the other ones in a extension from the body wall.

11. A hair gripping device according to claim 1, wherein the partition walls comprise at least two couples of partition walls longitudinally spaced to each other on an inner side wall of the body portion, each couple of partition walls comprising two partition walls formed at opposite side, each couple of the partition walls being staggered by 90 degrees with respect to a neighboring couple of partition walls.

12. A hair gripping device to be mounted on a hair accommodating means to grip a bundle of hair in a predetermined friction force during hair braiding, comprising:

a tapered head portion having a nozzle for the bundle of hair to pass through; and a body portion, extended from the head portion in one piece, having a plurality of partition walls to give the bundle of hair helical bends encircling a longitudinal axis of the body portion wherein the plurality of partition walls being longitudinally apart from each other in a predetermined distance.

13. A hair gripping device according to claim 12, wherein the body portion is in cylindrical shape.

14. A hair gripping device according to claim 12, wherein the partition walls are extended from an inner side wall thereof more than an inner radius of the body portion to form an almost semi-circle plate, each partition wall being staggered to an adjacent partition wall by a predetermined angle.

15. A hair gripping device according to claim 14, wherein two neighboring partition walls are staggered each other in such a manner that a non-overlapped opening formed by two neighboring partition walls is smaller than a quarter of a full circle.

16. A hair gripping device according to claim 12, wherein the body portion has at least one annular groove on an outer wall to reduce the thickness thereof.

17. A hair gripping device according to claim 12, wherein the head portion, body portion, and each partition wall are made of elastic rubber in a piece.

18. A hair gripping device according to claim 12, wherein the partition wall is formed in such a manner that the bottom connected to the body portion is thicker than the end thereof.

19. A hair gripping device according to claim 18, wherein each of the partition walls has a tapered side.

20. A hair gripping device according to claim 12, wherein each of the partition walls has a neck portion to be connected to the body portion in a predetermined curvature, the neck portion being gradually thicker from the end to the body portion.

21. A hair gripping device according to claim 12, wherein some of the partition walls is different from the other ones in a extension from the body wall.

* * * * *